United States Patent [19]

Legille et al.

[11] 4,153,440

[45] May 8, 1979

[54] TREATMENT OF METALLURGICAL SLAG

[75] Inventors: Edouard Legille; Paul Metz, both of Luxembourg, Luxembourg

[73] Assignee: Paul Wurth S.A., Luxembourg

[21] Appl. No.: 893,973

[22] Filed: Apr. 6, 1978

[30] Foreign Application Priority Data

Apr. 15, 1977 [LU] Luxembourg ..... 77145

[51] Int. Cl.[2] ..... C03B 5/18

[52] U.S. Cl. ..... 65/19; 65/20; 65/141; 65/142

[58] Field of Search ..... 65/19, 20, 141, 142

[56] References Cited

U.S. PATENT DOCUMENTS

| | | | |
|---|---|---|---|
| 821,609 | 5/1906 | Colloseus | 65/141 |
| 1,483,241 | 2/1924 | Opderbeck | 65/141 X |
| 2,210,999 | 8/1940 | Bartholomew | 65/19 |
| 3,054,139 | 9/1962 | Bartholomew et al. | 65/19 |
| 3,594,142 | 7/1971 | Margesson et al. | 65/141 X |
| 3,607,168 | 9/1971 | Grady | 65/141 X |

FOREIGN PATENT DOCUMENTS

| | | | |
|---|---|---|---|
| 103175 | 2/1938 | Australia | 65/20 |

*Primary Examiner*—Robert L. Lindsay, Jr.
*Attorney, Agent, or Firm*—Watson, Cole, Grindle & Watson

[57] ABSTRACT

Disclosed is a process for the treatment of metallurgical slag, the process comprising mechanical disintegration of a current of pyroplastic slag formed by initial cooling of a current of melting slag by means of water. This cooling comprises a first cooling phase taking place in the course of the flow of a continuous current of slag through an inclined channel into which a variable quantity of water is injected by pressure through the base, and a second cooling phase taking place during the largely free fall of the flow of slag onto a disintegration device. The initial slag cooling phase is accelerated or decelerated in accordance with the properties of the slag, and the intensity and/or duration of the mechanical disintegration is modified in accordance with the physical and granulometric properties of the slag required.

A further aspect of the invention provides an installation for the performance of the process as set forth above. The installation comprises means for the mechanical disintegration of the flow of pyroplastic slag from a blast furnace, and an inclined flow channel provided with means for the injection of the water through the base of the channel. The inclined flow channel is adjustable in its angle of inclination and the disintegration device comprises adjustable and/or interchangeable active elements.

8 Claims, 6 Drawing Figures

Fig. 3
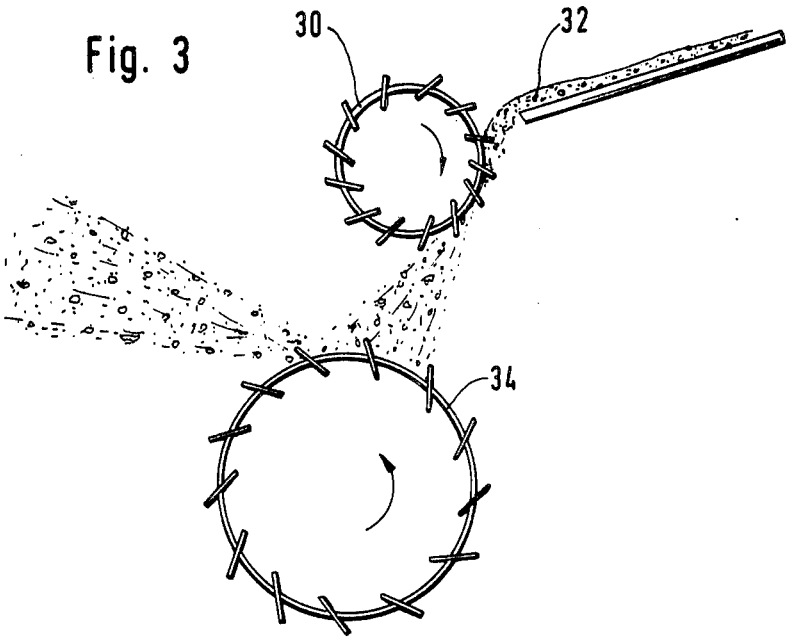
Fig. 6
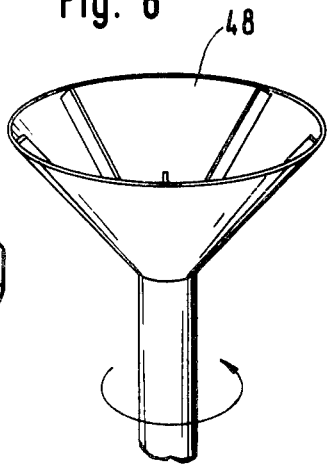
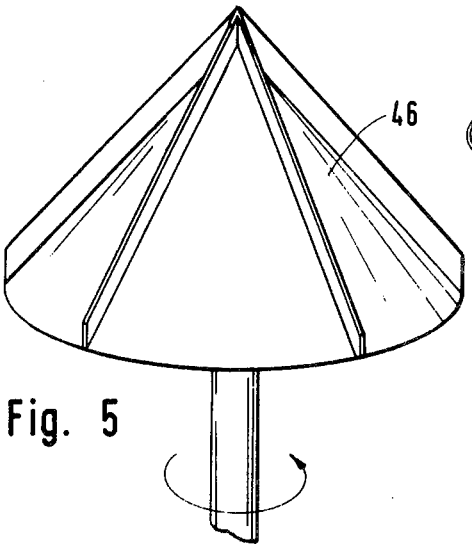
Fig. 5

TREATMENT OF METALLURGICAL SLAG

The present invention relates to a process for the treatment of metallurgical slag, comprising mechanical disintegration of a current of pyroplastic slag formed by initial cooling of a current of molten slag water, this cooling comprising a first cooling phase taking place in the course of the flow of a continuous current of slag through an inclined channel into which a variable quantity of water is injected by pressure through the base, and a second cooling phase taking place during the largely free fall of the flow of slag onto a disintegration device. The invention also relates to an installation for the performance of this process.

Luxembourg Patent No. 73,623 describes a process and an installation of this kind for the production of expanded slag. In the patent, the mechanical disintegration device consists of a rotary drum fitted with blades which throw the particles of slag over a certain distance so that the particles fall into a receiving vat. In the final part of their trajectory, the particles of slag thrown by this disintegrating drum pass through vaporized water which assists their coagulation and solidification.

A system has also been proposed in which the receiving vat for the particles of slag thrown off by the disintegration drum is replaced by an endless conveyor belt consisting of wire netting. An endless belt of this kind enables the solidified particles of slag to be drained and also evacuated as and when the slag is produced.

One of the main purposes of an installation of this kind is to obtain expanded or granulated slag or even mineral wool of uniform and reproducible quality. These criteria depend not only on the process adopted and the installation employed but also on the physical and chemical properties of the slag produced by the blast furnace, on the conditions under which the furnace is operated and on the nature and properties of the ore concerned. Because of these criteria the known processes and installations for the production of solidified slag do not enable uniform quality to be obtained, since they do not contain means for controlling the various parameters which influence the solidification and/or disintegration of the slag in order to balance out the effects of the aforementioned conditions which govern the physical and chemical properties of the slag produced by the blast furnace.

A purpose of the present invention is to provide a new process and installation for the treatment of metallurgical slag, which enables particles of solidified slag of uniform quality to be obtained, the quality being reproducible regardless of the properties of the slag produced by the blast furnace.

In accordance with the present invention, there is provided a process for the treatment of metallurgical slag, the process comprising mechanical disintegration of a current of pyroplastic slag formed by initial cooling of a current of melting slag by means of water, this cooling comprising a first cooling phase taking place in the course of the flow of a continuous current of slag through an inclined channel into which a variable quantity of water is injected by pressure through the base, and a second cooling phase taking place during the largely free fall of the flow of slag onto a disintegration device, the initial slag cooling phase being accelerated or decelerated in accordance with the properties of the slag, and the intensity and/or duration of the mechanical disintegration being modified in accordance with the physical and granulometric properties of the slag required.

In accordance with a further aspect of the invention, there is provided an installation for the performance of the process as mentioned above, the installation comprising means for the mechanical disintegration of the flow of pyroplastic slag in process of melting and coming from a blast furnace, and an inclined flow channel provided with means for the injection of the water via the base of the channel, the inclined flow channel being adjustable in its angle of inclination and the disintegration device comprises adjustable and/or interchangeable active elements.

In a first embodiment of the invention, the disintegration device consists of a drum fitted with a set of peripheral blades adjustable in the angle which they form relative to the drum surface.

In another embodiment the disintegration device comprises a removable and replaceable rotary element, the surface which receives the flow of slag having a series of radial ribs. This element may consist of a flat disc or conical element of which either the concave surface or the convex surface faces towards the current of slag.

In a further embodiment the installation comprises a number of disintegration devices arranged on the cascade principle.

The invention will be understood more clearly from the detailed description of a number of constructional versions discussed hereunder by way of examples without any limitative effect and reference to the accompanying drawings in which:

FIG. 3 is a schematic diagram of an installation with two disintegration drums arranged cascade-fashion;

FIGS. 5 and 6 show two disintegration elements which can be adopted in place of the disc shown in FIG. 4.

Figure 1:
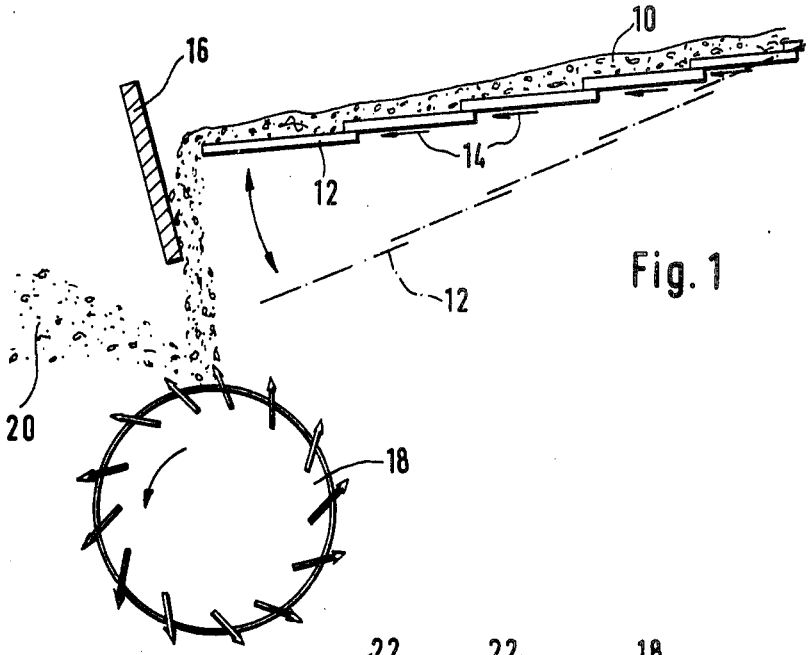
FIG. 1 is a schematic diagram of an installation according to the present invention with a flow channel set at a variable angle of inclination.

FIG. 1 shows a current of slag 10 coming from a blast furnace and flowing into an inclined channel 12 at the base of which water is injected in the direction shown by the arrows 14 in accordance with Luxembourg Patent No. 73,623. At the outlet from this flow channel 12, the slag falls freely guided by a deflector plate 16 onto a disintegration drum 18 which throws the mass of slag over a trajectory 20. The drum is preferably moistened continuously by water fed axially and discharged through its periphery. The trajectory 20 may advantageously pass through a sheet of vaporized water in order to assist in the coagulation of the particles of expanded slag.

For the production of expanded slag, the expansion proper takes place in the manner described in the aforementioned Luxembourg patent, i.e. the water injected through the base of the flow channel 12 evaporates when in contact with the very hot slag and penetrates the lower layers of the slag in order to cause the layers to swell. The water should preferably be allowed to trickle onto the plate 16 in order to continue the expansion during the free fall of the slag onto the disintegration drum 18.

In a method hitherto known for the control of the expansion process, the quantity of water introduced into the current of slag is suitably proportioned, this operation being combined with an adjustment to the rotation speed of the drum. A progressive reduction in the quantity of water thus results in an increase in the particles of granulated slag at the expense of the proportion of particles of expanded slag when the rotation speed of the disintegrating drum 18 is increased and the quantity of water reduced at the same time. The product obtained may thus be caused to consist largely of expanded slag or largely of granulated slag according to whether a relatively large quantity of water is introduced with a relatively low drum rotation speed, or only a small quantity of water with a higher drum rotation speed. It is even possible, by causing the drum to rotate at a sufficiently high speed, to bring about the formation of filamentous substances such as mineral wool.

The present invention proposes means by which the expansion or granulation phase can be accelerated or shortened in accordance with the chemical, physical and thermal properties of the slag produced by the blast furnace. For example, means already known per se are provided for the adjustment of the angle of inclination of the flow channel 12 so that the angle can be altered from a substantially horizontal position, such as that shown in full lines in FIG. 1, to a position inclined at a very sharp angle, as shown in broken lines in the said FIG. 1. An increase in the gradient of the flow channel 12 will obviously accelerate the flow of the current of slag 10 and thus reduced the period occupied by the expansion or inflation phase.

If the slag is of a type difficult to expand, the channel 12 will be raised until it is practically horizontal in order to decelerate the flow of slag and thus prolong the period during which it is subjected to the action of the water injected through the base of the channel 12.

If the slag is of a type easy to expand, the channel 12 can be pivoted towards the position shown in broken lines. It should be noted that if the angle of inclination of the channel 12 is increased, the turbulent flow of the current of slag 10 is thereby assisted thus facilitating the operation of stirring up the slag and improving its penetration by the water. On the other hand, the duration of the expansion phase will be reduced, not only as a result of the increase in the speed of the current 10 but also as a result of a reduction in the height of the free fall from the end of the channel 12.

One means hitherto known for varying the grain size of the slag thus cooled is to adjust the rotation speed of the disintegration drum 18, the finest granulometry being obtained at the highest speed.

Figure 2:
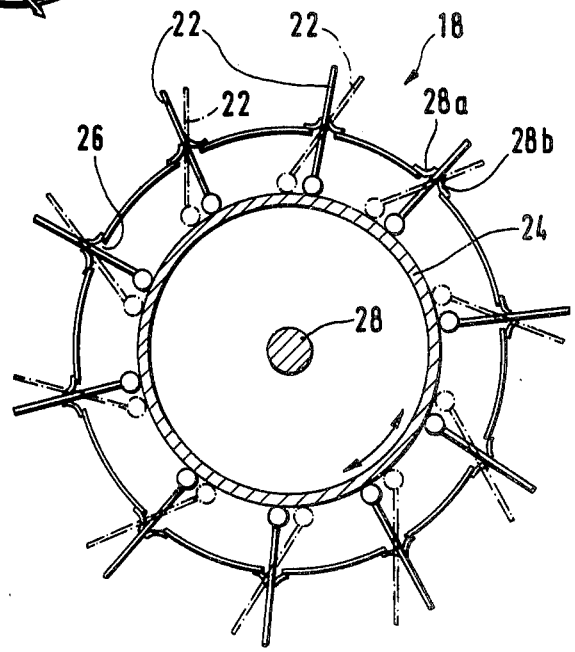
FIG. 2 is a schematic diagram of a disintegration drum with adjustable blades.

FIG. 2 shows a disintegration drum 18 designed in accordance with the present invention. This drum 18 is fitted with a set of blades 22 over its entire circumference. Each of these blades 22 is hinged to the surface of the cylinder 24 positioned coaxially inside the drum 18. These blades 22 pass through longitudinal slits 26 in the surface of the drum 18. The cylinder 24 is affixed in a manner known per se to a shaft 28 of the drum 18 in such a way that its angle in relation to the drum can be adjusted. This adjustment in the angular position of the cylinder 24 in relation to the drum 18 results in an adjustment of the angle of inclination of the blades 22 as shown in dot-and-dash lines. Furthermore, this adjustment in the angle of the cylinder 24 enables the blades to be extended from or retracted into the surface of the drum as desired. A sufficient rotation of the cylinder 24 enables the blades 22 to be withdrawn completely into the interior of the drum 18.

In order to prevent the slag from penetrating the drum 18 through the longitudinal slits 26, it is advantageous to provide flexible protectors **28*a* and 28*b* to close up these slits 26 while nevertheless enabling the blades to slide and change direction. The interior of the drum 18 can also be provided with a water supply conduit, not shown in the drawing, for the purpose of continuously moistening the surface of the said drum 18 via the slits 26** during operation.

The arrangement shown in FIG. 2 enables the blades 22 to be extended from the surface of the drum 18 to a greater or smaller distance according to the output of slag. Furthermore, by modifying the angle of inclination of the blades either in the direction of the rotation of the drum or in the opposite direction, it is possible to modify the trajectory followed by the slag 20 thrown off by the drum and thus keep the slag in the air or in the sheet of vaporized water for a longer or shorter period of time. This adjustment enables the effects of temperature variation or of the constitution of expanded slag to be balanced out in order to obtain particles of expanded or granulated slag of uniform quality.

An additional advantage of the blades being adjustable in their angle of inclination is the possibility of selecting the angle at which the noise caused by the disintegrating operation will be reduced to the minimum.

In the installation shown in FIG. 3, an additional drum 30 is provided upstream from the main disintegration drum 34. The purpose of the said drum 30 is to enable a flow of slag 32 which has undergone expansion or initial cooling in a flow channel similar to that of FIG. 1 to be stirred more satisfactorily and to initiate its disintegration. This supplementary drum 30 is also provided with peripheral blades and is either continuously irrigated with water or equipped with internal pipes serving to supply the water via the interior to the surface of the drum and thus to continue the expansion or granulation of the slag 32. The blades of this drum 30 are preferably adjustable in the manner shown in FIG. 2. This enables the drum 30 to be rotated either in the direction shown by the arrow in FIG. 3 or in the opposite direction by positioning the blades in the said opposite direction. Needless to say, the rotation speed of this drum 30 is lower than that of the drum 34 so that the slag will not be flung to one side of the drum 34.

Figure 4:
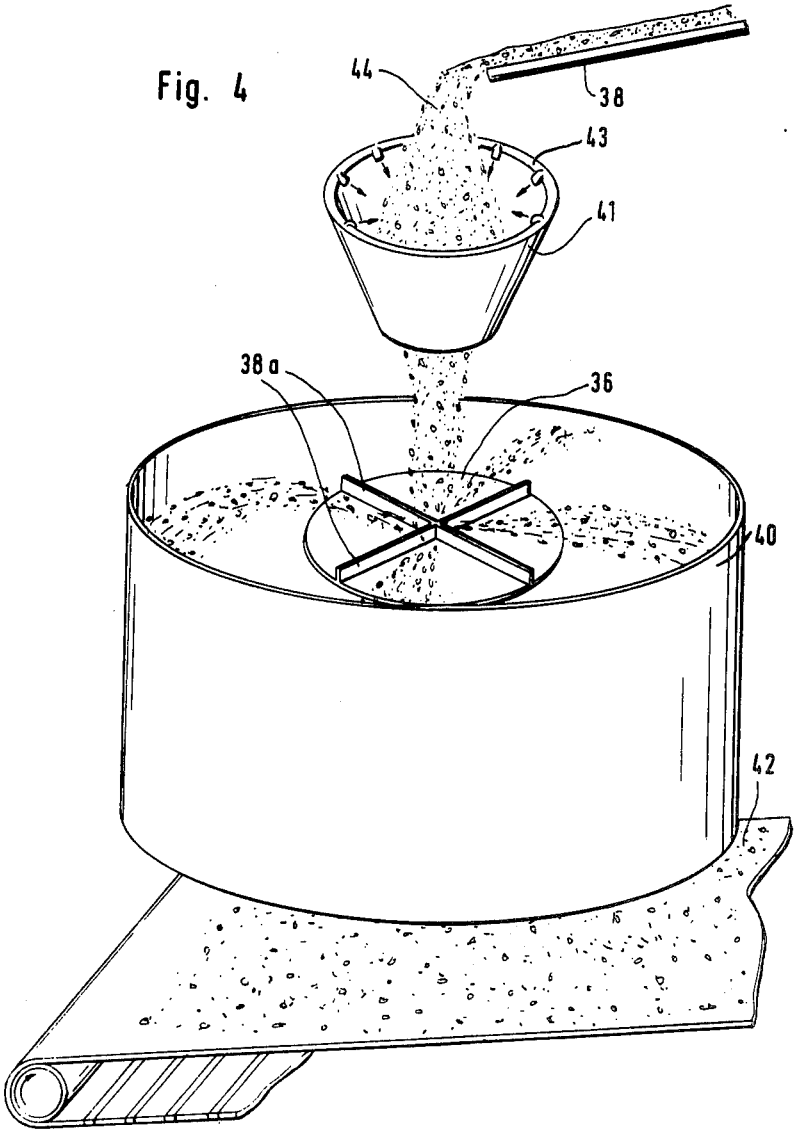
FIG. 4 shows a disintegration device for expanded slag, with a rotary disc and a receiving belt.

FIG. 4 shows an installation in which the disintegration device consists of a rotary disc 36 fitted with radial ribs. As in the case of FIG 1, the slag undergoes sudden cooling in a slanting flow channel 38 before falling into a funnel 41. A water conduit 43 is provided at the top of this funnel and serves to throw the water onto the current of slag 44 or cause the water to trickle along the wall of the funnel 41 and continue the slag cooling operation which has been commenced in the flow channel 38.

From the funnel 41, the slag 44 drops onto the rotor disc 36 rotating about an axis which, in the case of FIG. 4, is situated in the same direction as that in which the slag 44 falls. The purpose of this rotor disc 36 is similar to that of the disintegration drum in the previous diagrams. By the rotation of the disc 36, the slag is thrown to a certain distance which depends on the rotation speed of the disc. As in the case of Luxembourg Patent No. 73,623, a water vaporising system can be included in order to irrigate the slag thrown from the rotation disc 36. In order to limit the trajectory of the particles thus thrown, it is possible to provide an enclosure or shield 40 such as that shown in FIG. 4 as a means of intercepting the slag thrown by the rotating disc 36. It is advantageous for a shield 40 of this kind to be supplemented by a conveyor belt 42 serving to recuperate the expanded or granulated slag underneath the shield 40 and evacuate the slag as and when it accumulates. The wire netting of this conveyor belt 42 also enables the slag to be drained.

Water nozzles can be provided at the top of the shield 40 in order to spray water onto the slag thrown off by the disc 36 and thus assist in the cooling and coagulation of the particles of expanded or granulated slag.

It should be noted that the installation is not shown to scale in FIG. 4 as the radius of the shield 40 in relation to that of the disc 36 is greater than would appear from the diagram.

As a means of adjusting the conditions under which the expanded slag disintegrates, interchangeable disintegration discs have been provided. For example, the disc 36 can be replaced by one of the disintegration cones 46 and 48 shown in FIGS. 5 and 6 respectively. Each of these cones is provided with a set of ribs situated on the side receiving the slag. The choice between the two cones 46 and 48 depends on the rotation speed and the distance to which it is desired to throw the slag. If this distance is comparatively short, the operation will be carried out with a cone 46 having the tip nearer to the funnel 41. On the other hand, if high speeds are involved and it is desired to throw the slag a greater distance, use will be made of the cone 48 having the hollow part facing towards the funnel 41.

Needless to say, a complete set of disintegration cones varying in their opening angles can be used, the cone selected depending on the disintegration conditions prevailing.

What we claim is:

1. An installation for the treatment of metallurgical slag comprising an inclined flow channel provided with means for the injection of water via the base of the channel, the inclined flow channel being adjustable in its angle of inclination, and a disintegration device for the mechanical disintegration of a flow of pyroplastic slag from a blast furnace through the flow channel, the device comprising a rotary drum having a set of peripheral blades passing through longitudinal slits in the surface of the drum and hinged to a cylinder positioned coaxially inside the drum, the angular position of the blades being adjustable in relation to the drum.

2. An installation for the treatment of metallurgical slag comprising an inclined flow channel provided with means for the injection of water via the base of the channel, the inclined flow channel being adjustable in its angle of inclination, and a disintegration device for the mechanical disintegration of a flow of pyroplastic slag from a blast furnace through the flow channel, the device comprising an interchangable rotary element, the side of which receiving the current of slag being provided with a set of radial ribs.

3. An installation as claimed in claim 1, further including flexible protectors provided along the edges of the slits of the drum in order to prevent slag from penetrating to the interior of the drum.

4. An installation as claimed in claim 1, further comprising a supplementary drum fitted with peripheral blades and situated upstream from the disintegration drum and downstream from the inclined flow channel.

5. An installation as claimed in claim 4, wherein the angle of inclination of the blades of the supplementary drum is adjustable.

6. An installation as claimed in claim 2, further including a funnel situated downstream from the flow channel and serving to direct the current of slag onto the rotary element.

7. An installation as claimed in claim 6, further comprising a water conduit having nozzles situated along the upper periphery of the said funnel and serving to cause water to trickle over the internal surface of the funnel.

8. An installation as claimed in claim 2, wherein the rotary element comprises a disc designed to rotate about an axis generally coinciding with the direction of fall of the expanded slag.

* * * * *